US010570731B2

(12) United States Patent
Jones et al.

(10) Patent No.: US 10,570,731 B2
(45) Date of Patent: Feb. 25, 2020

(54) SOLVENT EXTRACTION AND ANALYSIS OF FORMATION FLUIDS FROM FORMATION SOLIDS AT A WELL SITE

(71) Applicant: Halliburton Energy Services, Inc., Houston, TX (US)

(72) Inventors: Christopher Michael Jones, Houston, TX (US); Ian D. C. Mitchell, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/426,506

(22) PCT Filed: Oct. 3, 2013

(86) PCT No.: PCT/US2013/063257
§ 371 (c)(1),
(2) Date: Mar. 6, 2015

(87) PCT Pub. No.: WO2015/050550
PCT Pub. Date: Apr. 9, 2015

(65) Prior Publication Data

US 2016/0032718 A1 Feb. 4, 2016

(51) Int. Cl.
*E21B 21/01* (2006.01)
*E21B 49/00* (2006.01)
*E21B 21/06* (2006.01)

(52) U.S. Cl.
CPC ..... *E21B 49/005* (2013.01); *E21B 21/01* (2013.01); *E21B 21/065* (2013.01); *E21B 21/066* (2013.01); *E21B 21/067* (2013.01)

(58) Field of Classification Search
CPC ..... E21B 49/005; E21B 21/01; E21B 21/065; E21B 21/066; E21B 21/064
(Continued)

(56) References Cited

U.S. PATENT DOCUMENTS 4,635,735 A 1/1987 Crownover
5,092,983 A * 3/1992 Eppig ..... B01D 11/02 208/13

(Continued)

OTHER PUBLICATIONS

International Search Report and Written Opinion issued in related PCT Application No. PCT/US213/063257 dated Jun. 26, 2014, 12 pages.

(Continued)

*Primary Examiner* — John Fitzgerald
*Assistant Examiner* — Rodney T Frank
(74) *Attorney, Agent, or Firm* — Jason Sedano; Baker Botts L.L.P.

(57) ABSTRACT

Systems and methods for extracting and analyzing formation fluids from solids circulated out of a subterranean formation are provided. In one embodiment, the methods comprise: providing a sample of formation solids that have been separated from a fluid circulated in at least a portion of a well bore penetrating a portion of a subterranean formation at a well site; performing a solvent extraction on the sample of formation solids using one or more solvents at an elevated pressure at the well site, wherein at least a portion of one or more formation fluids residing in the formation solids is extracted into the one or more solvents to produce an extracted fluid; and analyzing the extracted fluid at the well site to determine the composition of the extracted fluid.

8 Claims, 3 Drawing Sheets

(58) Field of Classification Search
USPC ..... 73/152.28
See application file for complete search history.

(56) References Cited

U.S. PATENT DOCUMENTS

| | | | | |
|---|---|---|---|---|
| 2002/0144717 | A1* | 10/2002 | Tunnicliffe | B01D 11/0203 134/26 |
| 2008/0099241 | A1 | 5/2008 | Ibrahim et al. | |
| 2009/0050369 | A1 | 2/2009 | Pop et al. | |
| 2011/0040501 | A1* | 2/2011 | Martin | E21B 47/10 702/45 |
| 2011/0084202 | A1 | 4/2011 | Finlay | |
| 2011/0094736 | A1 | 4/2011 | Evrard | |
| 2012/0118040 | A1 | 5/2012 | Difoggio et al. | |
| 2013/0319104 | A1* | 12/2013 | Schexnaider | E21B 49/005 73/152.42 |

OTHER PUBLICATIONS

International Preliminary Report on Patentability issued in related Application No. PCT/US2014/063257, dated Apr. 14, 2016 (9 pages).

* cited by examiner

SOLVENT EXTRACTION AND ANALYSIS OF FORMATION FLUIDS FROM FORMATION SOLIDS AT A WELL SITE

CROSS-REFERENCE TO RELATED APPLICATION

This application is a U.S. National Stage Application of International Application No. PCT/US2013/063257 filed Oct. 3, 2013, which is hereby incorporated by reference in its entirety.

BACKGROUND

The present disclosure relates to subterranean operations and, more particularly, to systems and methods for extracting and analyzing formation fluids from solids (e.g., cuttings) circulated out of a subterranean formation.

The performance of subterranean operations entails various steps, each using a number of devices. Many subterranean operations entail introducing one or more treatment fluids into the subterranean formation. For instance, drilling operations play an important role when developing oil, gas or water wells or when mining for minerals and the like. During the drilling operations, a drill bit passes through various layers of earth strata as it descends to a desired depth. During the drilling process, the drill bit generates drill cuttings as it forms the well bore. Drill cuttings consist of small pieces of shale and rock. The drill cuttings, as well as other particulate solids in the well bore (e.g., fines), are carried in a return flow stream of the drilling fluid back to the well drilling platform. They are then separated from the bulk of the drilling fluid via conventional separators such as shale shakers, mud cleaners, and centrifuges. Some shale shakers filter coarse material from the drilling fluid while other shale shakers remove finer particles from the drilling fluid. After removing the solids therefrom, the drilling fluid may be re-used in the drilling process.

Properties of the drilling fluid are typically monitored at a well site during drilling operations, for example, to measure hydrocarbon gas concentrations as the drilling fluid is circulated out of the well bore. The level of the hydrocarbon gas may affect decisions regarding how the well is to be drilled as well as the safety of the drilling rig and personnel involved. Moreover, the concentration of hydrocarbon gases and other components present in the drilling fluid may be indicative of the characteristics of the formation being drilled, reservoir fluids in the formation, and/or the drilling environment. Accordingly, the analysis of drilling fluids and the changes they undergo during drilling operations may be important to the methods of drilling as well as the efficiency of the drilling operations.

One method for collecting and analyzing hydrocarbon gas concentrations at a well site involves the use of a "gas trap" to collect gases released from the drilling fluid and/or solids suspended therein. A rotor within a vessel is submerged into the drilling fluid as the drilling fluid exits the well bore. The drilling fluid is agitated as it enters into and exits out of the vessel and some of the gases dissolved therein evaporate and escape the confines of the fluid. These vaporized gases are then collected and processed by analytical methods to determine the presence and levels of hydrocarbons and other components. However, the accuracy and/or effectiveness of these methods may depend upon whether various components in the sample are readily vaporized and/or separated from the solid and liquid phases of the sample. If a particular component is less volatile or labile, it may not be present in a gas phase sample at all or in a disproportionate amount to the total amount of that component. Correction coefficients are sometimes applied to analytical results to account for incomplete vaporization of a sample or its components, but often these coefficients themselves may not accurately account for actual testing conditions, calibration of equipment, or other variables in a particular application.

Often formation solids, such as drill cuttings or other particulate material from a subterranean formation suspended in a drilling fluid may provide useful information about the subterranean formation from which they came and/or the status of various subterranean operations that have been performed in the formation (e.g., drilling operations). For example, such solids contain small amounts of the formation fluids (e.g., oil, water, etc.) of interest that are present in the formation. The permeability, porosity, rock composition, and/or other properties of the solids themselves also may be pertinent to a number of decisions about operations at the well site. In conventional methods of analysis, drill cuttings suspended in a drilling fluid sample may be filtered or otherwise separated from the drilling fluid when it is circulated to the surface. Often, the analysis of the drill cuttings themselves is limited to a visual inspection. In some cases, such drill cuttings may be sent to an offsite laboratory for further analysis. Such laboratory analysis typically involves a two-step process. First, the cuttings may be placed in an airtight container for some period of time and gases are permitted to evolve from the cuttings. The composition of these gases are then analyzed in a headspace analysis. Then, the remaining cuttings may be subjected to a solvent extraction process (for example, using a Sohxlet extractor) to remove formation fluids from the cuttings for analysis. However, the laboratory solvent extractions typically used in this analysis often take several hours (and in some cases multiple days) to complete.

BRIEF DESCRIPTION OF THE FIGURES

These drawings illustrate certain aspects of some of the embodiments of the present disclosure, and should not be used to limit or define the disclosure.

Figure 1:
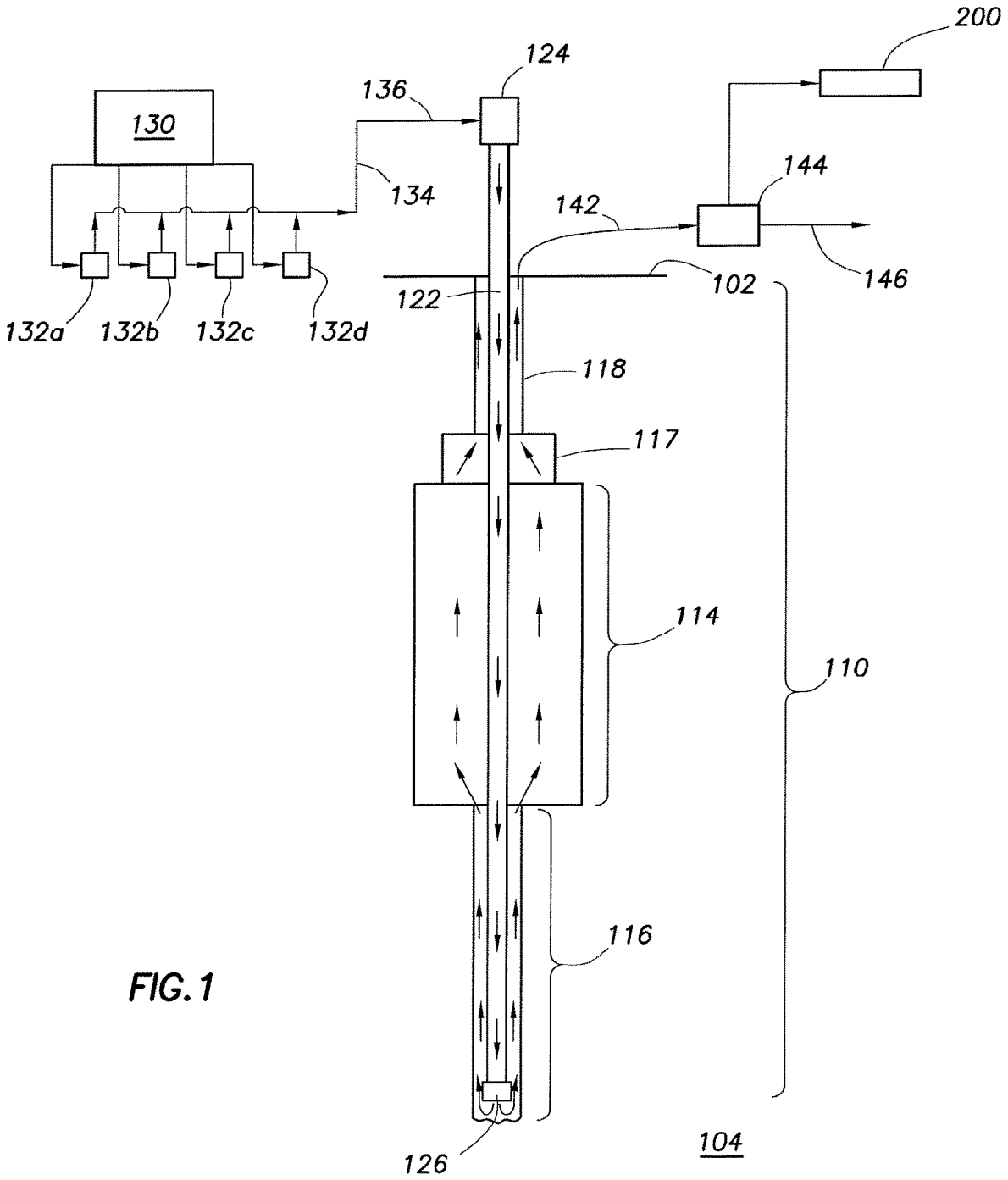
FIG. 1 is a diagram illustrating a well site where a well bore is drilled.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The present disclosure relates to subterranean operations and, more particularly, to systems and methods for extracting and analyzing formation fluids from formation solids (e.g., drill cuttings) circulated out of a subterranean formation at a well site.

The present disclosure provides methods and systems for extracting and analyzing formation fluids from samples of formation solids that have been circulated out of a well bore at elevated pressures at a well site. As used herein, the term "formation solids" refers to any solid material, including drill cuttings or any other particulate material (e.g., rock, shale, sand, etc.) originating in the subterranean formation and brought to the surface. The methods and systems of the present disclosure include providing a sample of formation solids that have been circulated out of a well bore in a pressurizable container at well site, adding one or more solvents to the pressurizable container at an elevated pressure so as to extract at least a portion of one or more formation fluids residing the formation solids into the solvent(s). The solvent comprising the extracted formation fluids is maintained at a pressure sufficient to maintain substantially all of the extracted sample in its liquid phase (i.e., without a significant component in the gas phase). The composition of the extracted formation fluids in the solvent is then determined using one or more analytical methods (e.g., chromatography, mass spectrometry, etc.) at the well site.

The methods and systems of the present disclosure may, among other benefits, simplify the analysis of formation fluids and solids and/or reduce the amount of time needed to perform such analysis. For example, these methods and systems may enable the extraction and analysis of formation solids and/or formation fluids residing therein without the need for secondary analysis conducted at an offsite laboratory. In certain embodiments, these methods and systems may provide data to an operator regarding a subterranean formation and/or reservoir fluids substantially in or near real-time, for example, in the course of a drilling operation. The methods and systems of the present disclosure also may provide a more accurate quantitative characterization of formation fluids as compared to certain other analytical methods. The methods and systems of the present disclosure also may facilitate the characterization of a formation and/or reservoir fluids based on surface measurements, reducing or eliminating the need for downhole analytical or sampling equipment. By extracting formation fluids from the formation solids at elevated pressures, the methods and systems of the present disclosure may eliminate the need to extract and/or analyze the gas phase of a sample, and may provide more concentrated sample for analysis as compared to conventional extraction methods.

The methods and systems of the present disclosure may be used at a well site at which a well bore is disposed in a subterranean formation. A well bore may be created so as to extend into a reservoir located in the subterranean formation. In one embodiment, a casing may be disposed within the well bore and cement may be introduced between the casing and the well bore walls in order to hold the casing in place and prevent the migration of fluids between the casing and the well bore walls. A tubing string may be disposed within the casing. In an embodiment, the tubing string may be jointed tubing, coiled tubing, or any other type of tubing suitable for use in a subterranean well environment. Suitable types of tubing and an appropriate choice of tubing diameter and thickness may be known to one skilled in the art, considering factors such as well depth, pressure, temperature, chemical environment, and suitability for its intended use.

FIG. 1 illustrates one example of a typical drilling operation in which the present disclosure can be used. In the exemplary drilling operation, a well bore 110 is drilled from the drill floor 102 to a subterranean formation 104 containing a reservoir. The well bore may include cased hole 114 and open hole 116. In the cased hole 114, the well bore 110 is sealed off from the subterranean formation 104 with metal casing, cement, or other means. In the open hole 116, the well bore 110 is exposed to the subterranean formation 104 and fluids may flow between the well bore 110 and the subterranean formation 104. A blowout preventer (BOP) stack 117 may be disposed above the cased hole 114. A riser 118 may connect the blowout preventer to the surface. A drill string 122 may be disposed within the well bore 110. A top drive 124 may rotate the drill string 122 to turn a bit 126 located at the bottom of the drill string 122.

The methods and systems of the present disclosure may be used with any fluid that is circulated in the well bore 110. During drilling operations, a drilling fluid (sometimes referred to as "mud") is typically circulated. The drilling fluid or mud may comprise any base fluid, including but not limited to water, oil, synthetic oil, and/or synthetic fluid. In certain embodiments, the drilling fluid may further comprise solids suspended in the base fluid. A non-aqueous based drilling fluid may contain oil or synthetic fluid as a continuous phase and may also contain water dispersed in the continuous phase by emulsification so that there is no distinct layer of water in the fluid. Such dispersed water in oil is generally referred to as an invert emulsion or water-in-oil emulsion. A number of additives may be included in such drilling fluids and invert emulsions to enhance certain properties of the fluid. Such additives may include, but are not limited to, emulsifiers, weighting agents, fluid-loss additives or fluid-loss control agents, viscosifiers or viscosity control agents, alkali, and the like.

In certain embodiments, the density of the drilling fluid is maintained in order to control the hydrostatic pressure that the mud exerts at the bottom of the well. If the drilling fluid is too light, formation fluids, which are at higher pressures than the hydrostatic pressure developed by the drilling fluid, can enter the well bore and flow uncontrolled to the surface, possibly causing a blowout. If the mud is too heavy, then the hydrostatic pressure exerted at the bottom of the well bore can reduce the rate at which the drill bit will drill the hole. Additionally, excessive fluid weights can fracture the formation and in some cases cause serious well bore failures. A person of skill in the art with the benefit of this disclosure will know how to use the appropriate additives to control the weight of the drilling fluid.

As shown in FIG. 1, the drilling fluid is circulated in the well bore 110 through the drill string 122. Initially, the drilling fluid is pumped to the drill string 122 from an active pit system 130. Several booster pumps 132*a-d* may be used to help move the drilling fluid. The drilling fluid may be pumped through a stand pipe 134 and a kelly hose 136 to the top of the drill string 122. The drilling fluid is pumped from through the drill string 122 where it exits the drill string 122 through the bit 126. As the drilling fluid circulates within the well bore, it interacts with the fluids present in the subterranean formation and/or reservoir penetrated by the well bore. When this occurs, the concentration of certain components in the drilling fluid (e.g., hydrocarbons) may change depending on, among other things, the composition of fluids and/or other substances in the formation and/or reservoir. Formation solids such as drill cuttings in the well bore also may become suspended in the drilling fluid, and carried out of the well bore as the drilling fluid is returned to the surface. After circulation in the well bore, the drilling fluid then flows back up to the surface through the annular space between the drill string 122 and the well bore 110. When it reaches the surface, the drilling fluid flows through a flow out line 142.

The drilling fluid then may pass through a separator 144 that separates out solids suspended in the drilling fluid. Such a separator may include various types of devices known in the art for separating solids from a fluid, including but not limited to shakers, centrifuges, filters, magnetic separator devices, mud cleaners, or the like. In certain embodiments, the separator 144 may comprise a single or multiple stage separator that separates gases, liquids and solids. The liquid portion of the drilling fluid then may enter a return line 146 that may return the drilling fluid to the active pit system 130. The liquid and gaseous portions of the drilling fluid also may be subjected to additional treatments (e.g., flared off, skimmed to separate oils and aqueous fluids, and/or further cleaned) using additional equipment (not shown) prior to entering the return line 146. One or more samples of drilling fluids also may be taken from flow out line 142 for analysis using additional equipment (not shown). The data from this analysis (e.g., compositional data) relating may be used and/or considered in the analysis of the fluid sample extracted from the solids discussed below. A sample of the solids separated from the drilling fluid by separator 144 may be transferred to an extraction and analysis system 200 of the present disclosure. Additional solids in the separator 144 may be disposed of, for example, in a waste pit (not shown).

In certain embodiments, the solids sample may be collected in a pressurized environment, among other reasons, to maintain all or substantially all of the fluids residing in the solids sample in a liquid phase. However, in certain embodiments where, for example, the solids sample is not collected at pressure, a sample of the gaseous phase in the headspace area surrounding the solids sample may be collected and the composition of that gaseous phase may be analyzed. The collection and/or analysis may be accomplished using any means known in the art, which may involve techniques such as headspace analysis techniques, gas chromatography, mass spectrometry, and the like. The analysis of the gaseous phase may be conducted at the well site or at an offsite location. The data from this analysis may be used in conjunction with analysis of the fluid sample extracted from the solids, among other purposes, to provide a more accurate compositional analysis of the sample.

Figure 2:
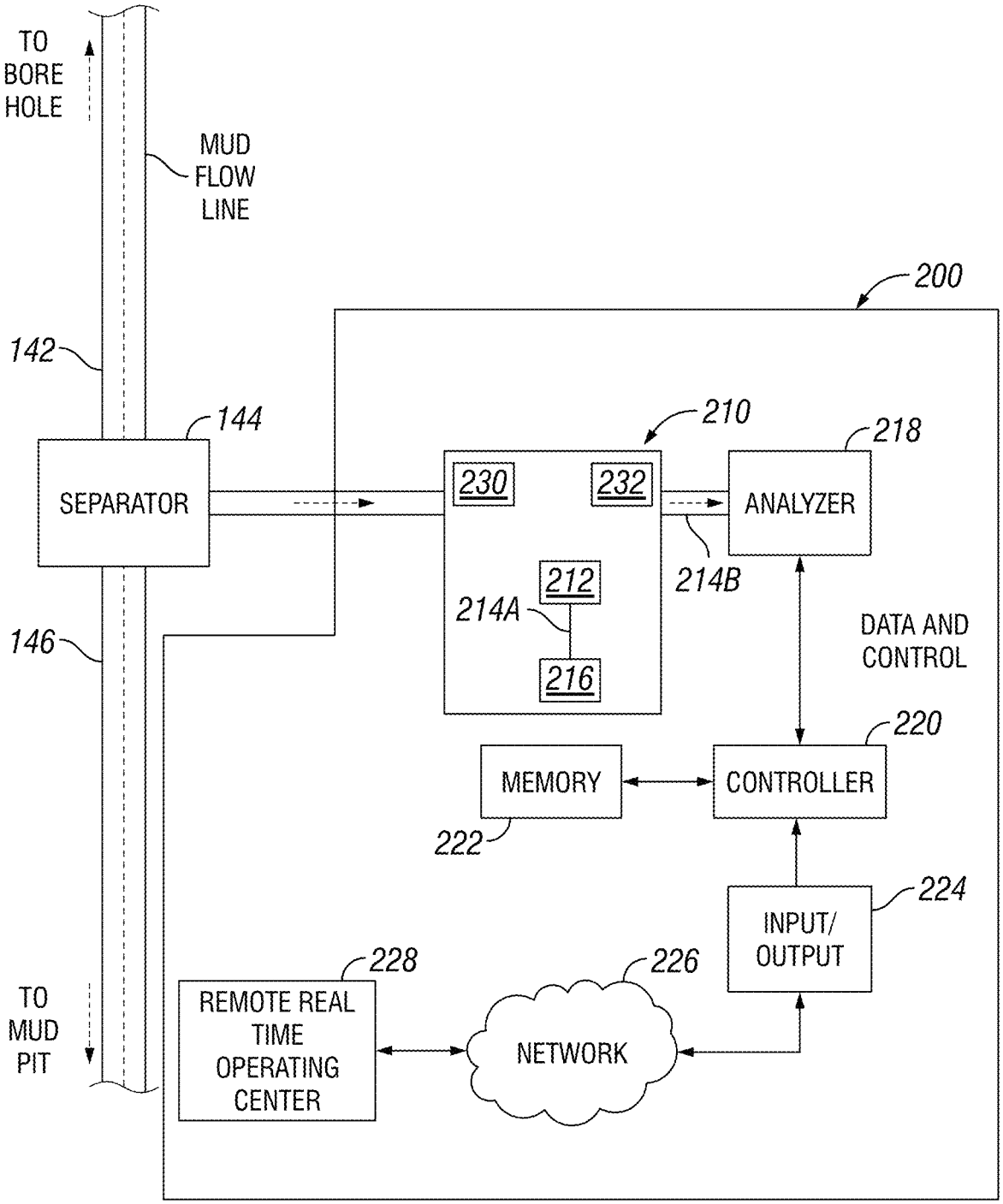
FIG. 2 is a diagram illustrating one example of an extraction and analysis system of the present disclosure.

Referring now to FIG. 2, in system 200, a sample of the solids separated from the drilling fluid is placed in a solvent extraction unit 210 where formation fluid in the pore spaces of the solids is extracted from the solids in a liquid phase using one or more solvents at elevated pressure. Solvent extraction unit 210 may be any device or system for performing solvent extractions known in the art. Generally, the solvent extraction unit 210 includes a pressurizable sample container 212 such as a sample cartridge or cell in which a solid sample may be placed, one or more solvent containers 216, one or more conduits 214*a* for introducing the solvent(s) from the solvent container(s) 216 into the sample container 212, and one or more conduits 214*b* for removing an extracted liquid sample from the sample container 212. The solvent extraction unit 210 also may include pumps 230 or other equipment that can maintain elevated pressures in the container (e.g., about 1000-2000 psi), as well as heaters 232 or other devices that can heat the solvent and/or the sample container to a range of temperatures (e.g., room temperature up to about 300° C.). In certain embodiments, the solvent(s) may be added to the sample container at an elevated temperature above ambient temperature (e.g., about 200° C.) and/or elevated pressure, among other reasons, to accelerate the solvent extraction process. Examples of commercially available solvent extraction systems that may be suitable for use in the methods of the present disclosure include, but are not limited to, the Dionex Accelerated Solvent Extraction (ASE) systems available from Thermo Fisher Scientific Inc. In certain embodiments of the present disclosure, the solvent extraction unit 210 may be capable of completing the extraction of a liquid sample of a suitable concentration in less than one hour.

The solvent(s) used in an embodiment of the present disclosure may be capable of dissolving one or more types of hydrocarbonaceous materials found in subterranean formations (e.g., asphaltenes, resins, saturates, and aromatics). In certain embodiments, suitable solvents may be capable of dissolving all types of hydrocarbonaceous materials found in the formation. Examples of solvents that may be suitable for use in certain embodiments of the present disclosure include, but are not limited to, terpenes, d-limonene, carbon tetrachloride, tetrachloroethylene, carbon disulfide, dichloromethane, derivatives thereof, and combinations thereof. A person of skill in the art, with the benefit of this disclosure, will be able to select an appropriate solvent(s) based on, among other factors, the expected composition of the formation fluid, the composition of the solid sample, the type of formation from which it was obtained, the applicable safety and environmental concerns in a particular application, and the like. As mentioned above, the solvent(s) may be heated (e.g., to about 200° C.) before the solvent is introduced into the sample container.

During and following the solvent extraction, the extracted fluid sample is generally kept at a pressure sufficiently high that substantially all of the extracted sample is maintained in a liquid phase. Generally, the minimum pressure will be the pressure needed to maintain the solvent at or above its critical point. In certain embodiments, the extracted sample may be pressurized to a pressure up to about 2000 psi. A person of skill in the art, with the benefit of this disclosure, will be able to determine the appropriate pressure to maintain substantially all of the extracted sample in the liquid phase based on, for example, the particular solvents used, temperature, and other factors.

The extracted fluid sample is then transferred via a conduit from the solvent extraction unit 210 to a fluid analyzer 218. The fluid analyzer 218 may be any analytical system or device known in the art for analyzing the composition of a fluid sample. Devices that may be suitable fluid analyzers in certain embodiments of the present disclosure include, but are not limited to chromatographic devices (e.g., gas chromatography, liquid chromatography, high-performance liquid chromatography (HPLC) devices), mass spectrometry devices, gas chromatography/mass spectrometry devices (GCMS), liquid chromatography/mass spectrometry devices (LCMS), infrared analytical devices, UV analytical devices, fluorescence analytical devices, differential viscosity analytical devices, electrochemical analytical devices, optical/refractive index analytical devices, selective ion analytical devices, integrated computational element (ICE) equipment, or any combination or modification thereof. The fluid analyzer 218 also may include one or more controllers, processors, memory, and/or other components that receive signals from the detector, control one or more components of the analyzer, process or store data relating to the analysis performed, and/or communicate with other components of the system 200. The fluid analyzer also may include one or more additional solvent containers and conduits for adding additional solvent(s) to the extracted sample before it is injected into the analytical column. In certain embodiments, the fluid analyzer or components thereof may be provided in a protective casing, among other reasons, to make the equipment more suitable for transportation and/or use at a well site.

The fluid analyzer 218 reports its data to a controller 220, which may display data from the fluid analyzer 218 relating to the composition of the fluid sample. Controller 220 also receives data from and controls other elements of the system 200 including: displaying and/or controlling the delivery pump 204 flow rate; displaying the density, flow rate, and temperature of the drilling mud measured by the meter 206; displaying and/or controlling the pressure, temperature, solvent flow rate, and/or other conditions or actions in the solvent extraction unit 210; and displaying and/or controlling the pressure, temperature, and/or other conditions or actions in the fluid analyzer. In certain embodiments, the controller 220 (or another controller or computer system communicatively coupled to that controller) may use the data from the fluid analyzer 218, alone or in combination with other data received by the controller, to determine the presence of one or more components in the fluid sample, the composition of the fluid sample, and/or one or more characteristics of the subterranean formation in which the fluid was circulated. Such characteristics of the formation may include, but are not limited to, the presence and/or amount of hydrocarbons, water, or other substances.

Controller 220 may comprise any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, the controller may be a personal computer, a network storage device, a network terminal, or any other suitable device and may vary in size, shape, performance, functionality, and price. The controller may include one or more processing resources such as a central processing unit (CPU) or hardware or software control logic. The controller may include a special purpose computer programmed to perform the functions described herein. Any suitable processing application software package may be used by the controller to process the data. Examples of special purpose computer systems programmed to perform these functions include, but are not limited to, those used in the SENTRY™ and INSITE™ services and systems provided by Halliburton Energy Services, Inc.

The controller 220 is coupled to a memory 222. The memory 222 contains the programs to be executed as the controller 220 performs its functions as well as constants and variables used to perform those functions. The controller 220 may be coupled to one or more input/output devices 224, such as a keyboard, a mouse, a monitor or display, a speaker, a microphone, or an external communications interface. The controller 220 also may include one or more buses operable to transmit communications between the various hardware components. In certain embodiments, the controller 220 produces data that may be presented to the operation personnel in a variety of visual display presentations such as a display communicatively coupled to the controller 220. In certain example systems, data from one or more analysis units and/or data regarding temperature, pressure, fluid volumes, or other conditions at the well site may be displayed to the operator using the display. The data may be presented to the user in a graphical format (e.g., a chart) or in a textual format (e.g., a table of values). In other example systems, the display may show warnings or other information to the operator when a central monitoring system detects a particular condition in a fluid sample, such as a certain amount of a hydrocarbon species.

The controller 220 may also be coupled to a network 226, such as a local area network or the Internet, either directly or through one or more of the input/output devices 224. In certain embodiments, such a network may permit the data from the controller 220 to be remotely accessible by any computer system communicatively coupled to the network via, for example, a satellite, a modem or wireless connections. As would be appreciated by those of ordinary skill in the art, with the benefit of this disclosure, a controller and/or computer system communicatively coupled to system 200 also may collect data from multiple well sites and/or wells to perform quality checks across a plurality of wells. The controller 220 may also be coupled to a remote real time operating center 228 through the input/output devices 224 and the network 226, allowing the remote real time operating center 228 to control and receive data from the controller 220. In certain embodiment, the data is pushed at or near real-time enabling real-time communication, monitoring, and reporting capability. This may, among other benefits, allow an operator to continuously monitor the status of the well bore and detect certain components in a fluid sample (e.g., hydrocarbons) at approximately the time that those components are encountered in a well bore (or shortly thereafter), and allow the collected data to be used in a streamline workflow in a real-time manner by other systems and operators concurrently with acquisition.

In certain embodiments, the fluids analyzer 218 and/or controller 220 may be configured (e.g., programmed) to omit signals or data relating to the solvent(s), which may help isolate components of the fluid sample that originated in the subterranean formation. In certain embodiments, the systems and methods of the present disclosure also may be used to analyze one or more samples of a well servicing fluid (e.g., drilling fluid) that has been circulated in a well bore to provide a baseline data set with which subsequent samples of the fluid (i.e., samples that have been circulated in a subterranean formation) may be compared. This baseline data set may, among other things, help isolate components of the fluid sample that originated in the subterranean formation. In certain embodiments, the fluids analyzer 218 and/or controller 220 may be configured (e.g., programmed) to omit or disregard signals or data relating to components that were present in a baseline data set. Such a baseline data analysis may be obtained at the start of a particular well bore operation, and in some embodiments may be repeated at certain intervals throughout the course of an operation, among other reasons, to provide more accurate data about the well servicing fluid before it is introduced into the formation.

In certain embodiments, the sampled solids may be subjected to one or more pre-treatments prior to the solvent extraction in the solvent extraction unit 210. For example, the solids may washed, centrifuged, and/or treated with a preliminary solvent extraction in an aqueous solvent, among other purposes, in order to remove excess liquids from the sample or to obtain a more concentrated fluid sample for analysis. The filtrate comprising any excess liquids may be returned to return line 146 for return to the active pit system 130 (e.g., directly or following one or more additional treatments) shown in FIG. 1.

Figure 3:
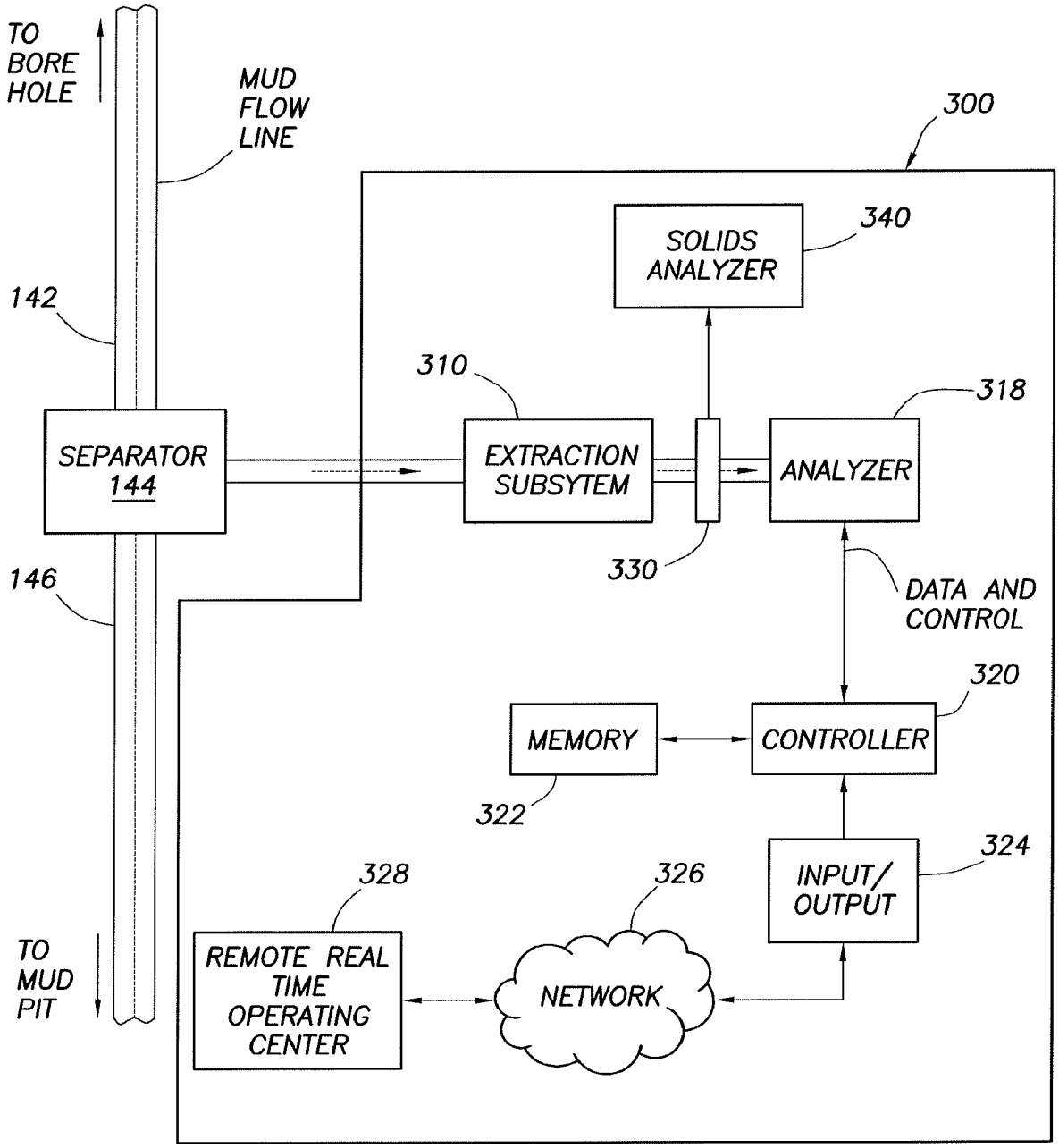
FIG. 3 is a diagram illustrating another example of an extraction and analysis system of the present disclosure.

One of the many advantages of the methods and systems of the present disclosure is that the solvent extraction methods used herein may remove substantially all residual fluids and gases from solids suspended in the fluid, thereby producing "cleaner" formation solids, which may be separately analyzed. Data from the analysis of the formation solids themselves may be used to determine a number of properties and/or phenomena of interest in a subterranean formation, such as the composition of soil and/or rock in a formation, the porosity and/or permeability of the formation, and the like. An example of an extraction and analysis system of the present disclosure in which solids may be removed from a fluid sample and separately analyzed is illustrated in FIG. 3. Such a system 300 may be used in place of or in addition to system 200 shown in FIG. 1. Referring now to FIG. 3, the extraction and analysis system 300 includes similar components to those of system 200 shown in FIG. 2 (i.e., a solvent extraction unit 310, a fluids analyzer 318, a controller 320, a memory 322, one or more input/output devices 224, a network 326, and a remote real time operating center 328). The system 300 further includes a solids filter 330 placed between the solvent extraction unit 310 and the fluid analyzer 318, which collects and/or separates solids (e.g., drill cuttings) from the extracted fluid sample. In other embodiments, the solids filter 330 may be replaced with a different device or mechanism for collecting and/or separating solids from a fluid, including but not limited to centrifuges, screens, and the like. In system 300, the solids collected in solids filter 330 may be transferred (either manually or automatically) to a solids analyzer 340. The solids analyzer 340 may include any device used in the art for examining or analyzing small particulate solids such as drill cuttings, including but not limited to scanning electron microscopy (SEM) systems, X-ray diffusion (XRD) systems, laser-based spectroscopy systems, and the like. Examples of commercially-available solids analyzers that may be suitable for use in the methods and systems of the present disclosure include those systems used in the LithoSCAN™ and LaserStrat® services available from Halliburton Energy Services, Inc. The solids analyzer 340 reports its data to controller 320, where that data may be stored and/or processed in a similar fashion to the data from the fluids analyzer 318. In other embodiments where the extraction and analysis system itself does not incorporate a solids analyzer, solids from which formation fluids have been extracted may be analyzed using a separate apparatus.

The systems and methods of the present disclosure may be used to monitor and/or characterize fluids, formations, and/or subterranean reservoirs in conjunction with any subterranean operation in which one or more fluids are circulated in a well bore. For example, the systems and methods of the present disclosure may be used in drilling operations, such as the embodiment described in FIG. 1. However, the systems and methods of the present disclosure may be used in one or more other types of subterranean operations, including but not limited to cementing operations, stimulation operations (e.g., fracturing, acidizing, etc.), completion operations, remedial operations, and the like. A person of skill in the art, with the benefit of this disclosure, will recognize how to apply or implement the systems and methods of the present disclosure as disclosed herein in a particular operation.

The terms "couple" or "couples," as used herein are intended to mean either an indirect or a direct connection. Thus, if a first device couples to a second device, that connection may be through a direct connection, or through an indirect connection via other devices and connections. The term "communicatively coupled" as used herein is intended to mean coupling of components in a way to permit communication of information therebetween. Two components may be communicatively coupled through a wired or wireless communication network, including but not limited to Ethernet, LAN, fiber optics, radio, microwaves, satellite, and the like. Operation and use of such communication networks is well known to those of ordinary skill in the art and will, therefore, not be discussed in detail herein.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

An embodiment of the present disclosure is an extraction and analysis system that includes: a separator coupled to a flow out line at a subterranean well site for separating formation solids from a fluid flowing through the flow out line; a solvent extraction unit coupled to the separator, the solvent extraction unit comprising a pressurizable sample container that receives a sample of the formation solids, one or more conduits coupled to the pressurizable sample container for introducing one or more solvents into the pressurizable sample container to extract one or more fluids from the sample of the formation solids, and an outlet in the pressurizable sample container through which the extracted fluid may exit the pressurizable sample container; a fluid analyzer coupled to the outlet in pressurizable sample container that receives the extracted fluid and generates data relating to the composition of the extracted fluid sample; and a controller communicatively coupled to the fluid analyzer that receives data from the fluid analyzer relating to the composition of the extracted fluid. Optionally, the one or more solvents may include one or more terpenes. Optionally, the fluid analyzer is configured to omit data relating to the one or more solvents. Optionally, the controller is configured to disregard data relating to the one or more solvents. Optionally, the fluid analyzer includes at least one device selected from the group consisting of: a gas chromatography device, a liquid chromatography device, a high-performance liquid chromatography device, a mass spectrometry device, a gas chromatography/mass spectrometry device, a liquid chromatography/mass spectrometry device, an infrared analytical device, a UV analytical device, a fluorescence analytical device, a differential viscosity analytical device, an electrochemical analytical device, an optical/refractive index analytical device, a selective ion analytical device, an integrated computational element (ICE) equipment, and any combination thereof. Optionally, the controller is communicatively coupled to a network that permits data from the controller to be remotely accessed by a computer system at a remote location communicatively coupled to the network. Optionally, the controller is further configured to receive and use the data to determine one or more properties of the extracted fluid substantially in or near real time with an operation performed in the subterranean formation using the fluid. Optionally, the system further includes a solids filter coupled between the pressurizable container and the fluids analyzer that collects solid materials present in the sample of the fluid. Optionally, the system further includes a solids analyzer coupled to the solvent extraction unit that receives a portion of the sample of the formation solids from the solvent extraction unit and generates data relating to the properties of the formation solids, wherein the controller is communicatively coupled to the solids analyzer and receives data from the solids analyzer relating to the properties of the formation solids.

Another embodiment of the present disclosure is a method including the following steps: providing a sample of formation solids that have been separated from a fluid circulated in at least a portion of a well bore penetrating a portion of a subterranean formation at a well site; performing a solvent extraction on the sample of formation solids using one or more solvents at an elevated pressure at the well site, wherein at least a portion of one or more formation fluids residing in the formation solids is extracted into the one or more solvents to produce an extracted fluid; and analyzing the extracted fluid at the well site to determine the composition of the extracted fluid. Optionally, the extracted fluid is maintained at a pressure sufficient to maintain substantially all of the extracted fluid in a liquid phase through the step of analyzing the extracted fluid. Optionally, the method further includes the steps of: collecting a sample of a gaseous phase from an area surrounding the sample of formation solids; and analyzing the gaseous phase sample to determine its composition. Optionally, the method further includes analyzing a portion of the sample of formation solids at the well site to determine one or more properties of the formation solids after the step of performing a solvent extraction on the sample of formation solids. Optionally, the one or more solvents are heated to a temperature above ambient temperature prior to or during the step of mixing the sample with the one or more solvents. Optionally, the method further includes accessing data regarding composition of the extracted fluid from a remote location. Optionally, the method further includes using the composition of the extracted fluid to determine one or more characteristics of the subterranean formation. Optionally, the method further includes accessing data regarding the characteristics of the subterranean formation from a remote location. Optionally, the composition of the extracted fluid is determined substantially in or near real time with an operation performed in the subterranean formation.

Another embodiment of the present disclosure is a method including the following steps: using a drilling fluid to drill at least a portion of a well bore penetrating a portion of a subterranean formation at a well site; circulating at least a portion of the drilling fluid out of the well bore; separating a sample of formation solids from the portion of the drilling fluid; performing a solvent extraction on the sample of formation solids using one or more solvents at an elevated pressure at the well site, wherein at least a portion of one or more formation fluids residing in the formation solids is extracted into the one or more solvents to produce an extracted fluid; and analyzing the extracted fluid at the well site to determine the composition of the formation fluids in the extracted fluid; and using the composition of the extracted fluid to determine one or more characteristics of the subterranean formation. Optionally, the composition of the extracted fluid is determined substantially in or near real time with using the drilling fluid to drill the portion of the well bore.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. The terms in the claims have their plain, ordinary meaning unless otherwise explicitly and clearly defined by the patentee.

What is claimed is:

1. An extraction and analysis system comprising:

a separator coupled to a flow out line at a subterranean well site for separating formation solids from a drilling fluid flowing through the flow out line from a well bore;

a return line coupled to the separator, wherein the return line returns a filtrate comprising an excess liquid portion of the drilling fluid from the separator to a pit system;

a solvent extraction unit coupled to the separator, the solvent extraction unit comprising:

a pressurizable sample container that receives a sample of the formation solids separated from the drilling fluid by the separator, one or more conduits coupled to the pressurizable sample container for introducing one or more solvents at an elevated pressure into the pressurizable sample container to extract one or more fluids from the sample of the formation solids into the one or more solvents, wherein the pressurizable sample container maintains the extracted one or more fluids into the one or more solvents at a pressure to maintain the extracted one or more fluids into the one or more solvents in a liquid phase without a component in a gas phase as an extracted fluid, and wherein at least one of the one or more solvents comprises at least one of a terpene and a d-limonene capable of dissolving one or more types of hydrocarbonaceous materials, a pump, wherein the pump maintains the pressure in the pressurizable sample container, a heater, wherein the heater heats the pressurizable sample container to a temperature, and an outlet in the pressurizable sample container through which the extracted fluid may exit the pressurizable sample container;

a fluid analyzer coupled to the outlet in the pressurizable sample container that receives the extracted fluid and generates data relating to the composition of the extracted sample;

a solids filter coupled between the pressurizable container and the fluid analyzer that collects and separates solid materials present in the extracted fluid; and a controller communicatively coupled to the fluid analyzer that receives the generated data from the fluid analyzer relating to the composition of the extracted fluid.

2. The system of claim 1 wherein the one or more solvents comprise one or more terpenes.

3. The system of claim 1 wherein the fluid analyzer is configured to omit data relating to one or more components of the one or more solvents present in a baseline data set.

4. The system of claim 1 wherein the controller is configured to disregard data relating to one or more components of the one or more solvents present in a baseline data set.

5. The system of claim 1 wherein the fluid analyzer comprises at least one device selected from the group consisting of: a gas chromatography device, a liquid chromatography device, a high-performance liquid chromatography device, a mass spectrometry device, a gas chromatography/mass spectrometry device, a liquid chromatography/mass spectrometry device, an infrared analytical device, a UV analytical device, a fluorescence analytical device, a differential viscosity analytical device, an electrochemical analytical device, an optical/refractive index analytical device, a selective ion analytical device, an integrated computational element (ICE) equipment, and any combination thereof.

6. The system of claim 1 wherein the controller is communicatively coupled to a network that permits data from the controller to be remotely accessed by a computer system at a remote location communicatively coupled to the network.

7. The system of claim 1 wherein the controller is further configured to receive and use the generated data to determine one or more properties of the extracted fluid substantially in or near real time with an operation performed in the subterranean formation using the fluid.

8. The system of claim 1 further comprising a solids analyzer coupled to the solvent extraction unit that receives a portion of the extracted fluid of the formation solids from the solvent extraction unit and generates data relating to the properties of the formation solids, wherein the controller is communicatively coupled to the solids analyzer and receives data from the solids analyzer relating to the properties of the formation solids.

* * * * *